US005261992A

United States Patent [19]

Moll

[11] Patent Number: 5,261,992

[45] Date of Patent: Nov. 16, 1993

[54] PROCESS AND DEVICE FOR PRODUCING MULTILAYERED INDIVIDUAL PARTS OF GARMENTS

[75] Inventor: Philip Moll, Aachen, Fed. Rep. of Germany

[73] Assignee: Moll Automatische Nähsysteme GmbH, Alsdorf, Fed. Rep. of Germany

[21] Appl. No.: 474,004

[22] PCT Filed: Oct. 11, 1988

[86] PCT No.: PCT/EP88/00908

§ 371 Date: May 3, 1990

§ 102(e) Date: May 3, 1990

[87] PCT Pub. No.: WO89/03186

PCT Pub. Date: Apr. 20, 1989

[30] Foreign Application Priority Data

Oct. 13, 1987 [DE] Fed. Rep. of Germany ..... 3734659

[51] Int. Cl.[5] ..... B32B 31/12; A41H 43/04

[52] U.S. Cl. ..... 156/308.2; 156/566; 156/583.1

[58] Field of Search ..... 112/262.3, 262.1, 265.1, 112/121.11, 121.12, 121.15, 147, 104, 113, 121.29, 2, 141; 156/93, 60, 226, 309.6, 292, 227

[56] References Cited

U.S. PATENT DOCUMENTS

| | | | |
|---|---|---|---|
| 3,650,875 | 3/1972 | Kendall, Sr. | 156/559 |
| 3,661,681 | 5/1972 | Edelberg et al. | 156/559 X |
| 3,898,941 | 8/1975 | Crawford et al. | 112/147 X |
| 4,093,498 | 6/1978 | Wendell | 156/559 X |
| 4,324,004 | 4/1982 | Smith et al. | 156/93 X |
| 4,337,881 | 7/1982 | Off et al. | 112/121.15 X |
| 4,357,197 | 11/1982 | Wilson | 156/566 X |
| 4,549,916 | 10/1985 | Off et al. | 156/93 |
| 4,635,574 | 1/1987 | Fujita et al. | 112/121.12 |

FOREIGN PATENT DOCUMENTS 2570577 3/1986 France .

*Primary Examiner*—Peter Nerbun

*Attorney, Agent, or Firm*—McGlew & Tuttle

[57] ABSTRACT

Two upper fabric cuts and at least one insert are assembled into a processing unit prior to bonding, and this unit is sent after bonding to a magazine following a bonding press used for bonding. This process and the device used to carry out same are particularly suitable for producing cuffs and collars.

17 Claims, 12 Drawing Sheets 40
48
49
45
50
86
57
54
41
28
53
56
52
47
46
43
44
42
54
55
51

PROCESS AND DEVICE FOR PRODUCING MULTILAYERED INDIVIDUAL PARTS OF GARMENTS

FIELD OF THE INVENTION

The present invention pertains to a process for producing multilayered individual parts of garments, especially cuffs and collars, in which at least one coated insert, that is to be bonded to the upper fabric in a bonding press, is placed on the upper fabric and is subsequently further processed by sewing. The present invention also pertains to the production of such individual parts by using this process.

The present invention seeks to achieve further mechanization and automation of the production of individual parts of garments during their production. In particular, it pertains to the production of multilayered individual parts, especially cuffs and collars. These individual parts have hitherto been produced usually by first adhering to the upper fabric, that lies on the outside on the finished garment, an adhesive-coated reinforcing upper fabric, that will lie on the outside on the finished garment is subsequently placed on the adhered unit (bonding unit) so that the outsides of the two upper fabric cuts will lie one on another. The bonding unit thus produced is then sewn on three sides, turned, and pressed (ironed).

BACKGROUND OF THE INVENTION

A process for producing collars, cuffs, and the like, according to which two layers of fabric are bonded together with a water-soluble adhesive prior to further processing in order to prevent the two layers of fabric from being displaced relative to one another is described in West German Patent Specification No. 1,610,639. After the further processing, the bonding is abolished or removed by washing. This process is not suitable for producing collars or cuffs in which the fabric layer on the visible side is connected to a reinforcing insert.

West German Offenlegungsschrift No. DE-OS 19,58,830 discloses a process for producing the lower part of the collar of a suit or dress, according to which one of the surfaces of an insert, serving as a lower or intermediate lining, is provided with a uniform adhesive layer melting under the effect of heat. This insert is then placed with this coated side on a lower collar cut, after which the two parts are bonded to each other at individual points by means of a pressing die provided with heating tips so that one of the edges of the upper collar cut is pushed between the lower collar cut and the insert for fixation on the lower collar cut by a seam and subsequently ironed. An adhesive bond covering the entire surface area is thus produced between the insert and the lower collar cut.

One of the edges of the upper collar cut is pushed between the non-connected edge zones of the lower collar cut and the insert by hand. Because of the soft nature of the material, this is not simple, and is particularly problematic and time-consuming if fabrics with rough surfaces and high coefficients of friction are to be processed.

These prior-art production processes are expensive in the case of the production of collars, cuffs, and comparable individual parts of garments and are poorly suited for further mechanization and automation.

SUMMARY AND OBJECT OF THE INVENTION

It is a primary object of the present invention to simplify and automate the production of multilayered individual parts with coated insert pieces.

To attain this object, the process according to the present invention is characterized in that all the parts which will subsequently form the individual part:

in collars an upper fabric cut for the inner collar, an upper fabric cut for the outer collar, an insert, and possibly other inserts (e.g. a plurality of inserts), in cuffs an upper fabric cut for the inner cuff, an upper fabric cut for the outer cuff, and an insert are assembled to form a processing unit before the adhesion process. After leaving the bonding press, the processing units thus formed are delivered into a magazine and are stored therein individually, especially so that they can be removed therefrom one by one.

Consequently, according to the present invention, all the upper collar cuts and inserts are already assembled in an arrangement suitable for processing before the beginning of the "bonding" operation, i.e., when they are fed into the bonding press, so that this arrangement can be maintained until the individual part in question is finished. This leads to a considerable simplification of the production process in conjunction with the special storage of the processing units thus formed. The fact that the cuts are assembled only once also leads, on the whole, to time savings. Individual storage of the processing units also makes for good handling of same during their delivery from one work station to the next.

In an advantageous variant of the process according to the present invention, the insert is in the form of a continuous, coated material web, onto which the upper fabric cuts are placed as individual parts. It is thus possible to automate the feeding of the inserts to the bonding press. In addition, due to the inserts being attached to one another, the processing units can be sent through the bonding press more reliably. The inserts bonded together there are preferably cut off from each other after bonding, as a result of which individual, independent processing units are formed.

It is particularly advantageous to subdivide the material web serving to form the inserts prior to the bonding by stamping or cutting so that the inserts still remain connected to one another by residual connections at least at one point. This procedure guarantees that the processing units will still pass through the bonding press as concatenated units, and the residual connections can be easily cut after the bonding, even by hand if necessary, to produce individual processing units.

It is also proposed in this process that in the case of processing units which are to be used to produce cuffs, the edges of the upper fabric cut extending beyond the insert be folded over upward and downward before bonding to the insert. This leads to the folded-over edges of the upper fabric cuts being fixed sufficiently—albeit only temporarily—to maintain their shape after leaving the bonding press even without prior tacking until they reach the next processing station, especially until they reach the first sewing station used for preliminary tacking.

Further measures according to the present invention, include providing a magazine filled with processing units and a magazine to a sewing station for removal of the processing units one by one, performing the sewing operations, and subsequently returning the sewn units to the magazine wherein the magazine is subsequently fed through further processing stations. These features, including placing fabric cuts and inserts on a belt-type conveyor of a bonding press and cutting out the inserts after leaving the bonding press, pertain to the reliable guiding of the processing units as well as the connecting of two upper fabric cuts to the insert.

The device used to accomplish the task described in the introduction is characterized in that the magazine following the bonding station is designed for receiving, storing, and discharging individual processing units. The device according to the present invention preferably consists of a bonding press of conventional design, whose discharge side is provided with the magazine according to the present invention. Such a bonding press is described, e.g., in West German Offenlegungsschrift No. DE-OS 3,519,841. In a preferred embodiment of the device according to the present invention, the magazine is designed as a shelf type magazine with a plurality of shelves arranged one on top of another. Each shelf serves to receive one processing unit. If desired and designed properly, the shelves can also be used to receive a plurality of processing units. The shelves of the magazine are designed so that the processing units can be removed by delivery members, but also by hand, and be returned onto the same shelf or a different shelf after corresponding operations have been performed.

As an alternative to this, the magazine may also consist of a plurality of pallets stacked one on top of another, which are also designed to receive and store, preferably, one processing unit. In this design of the magazine, according to the present invention as a pallet type magazine, the processing units can also be removed from the magazine together with the pallets and be returned into the magazine after the processing.

For processing cuffs, in which marginal projections of the upper fabric cuts over the insert are usually folded down and up prior to bonding, the device according to the present invention has folding members at the entry side area of the bonding press, which automatically perform the folding of the edge zones of the upper fabric cuts during delivery. The processing units can thus be prepared for the bonding in a simple manner during feeding to the bonding press.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

The present invention will be explained below in connection with the production of cuffs and collars for outerwear.

Figures 1, 2, 3:
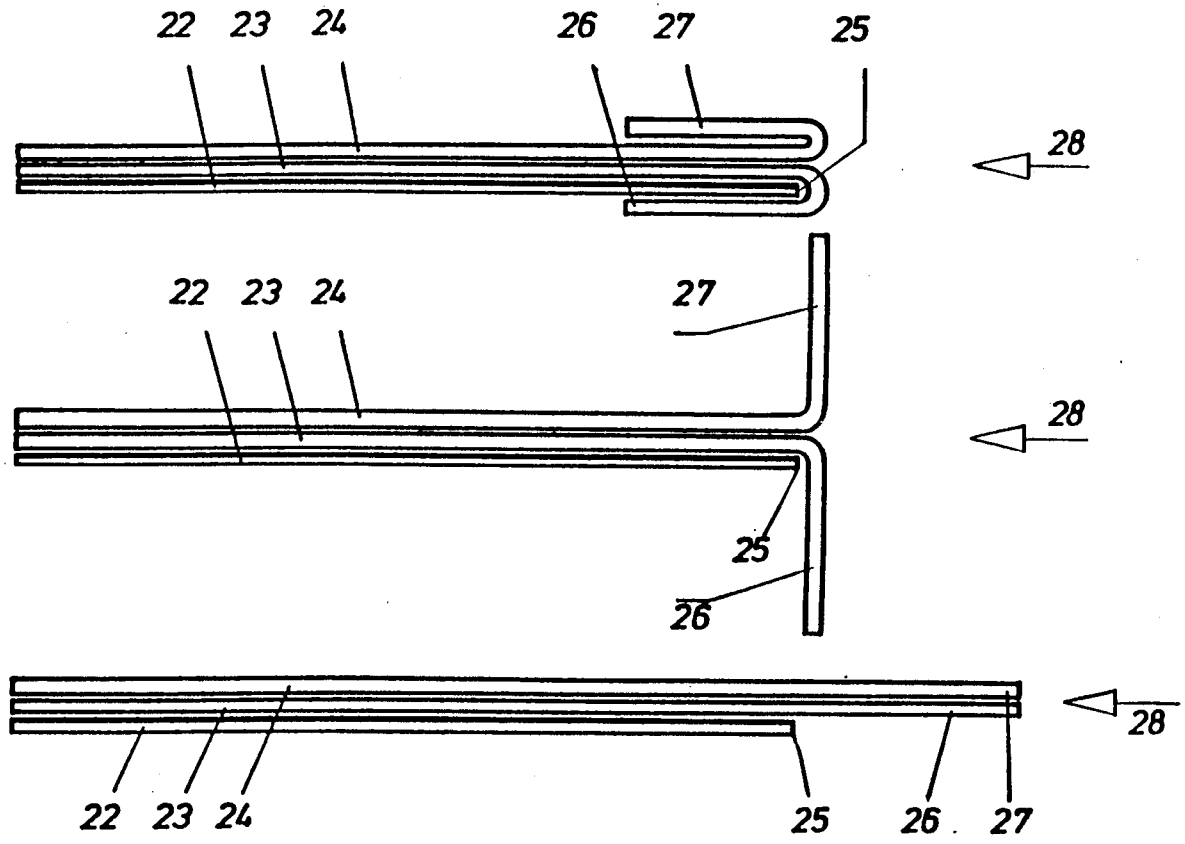
FIG. 1 is a schematic view of a processing unit for a cuff with two upper fabrics placed loosely over an insert.
FIG. 2 is a schematic view of the processing unit according to FIG. 1 with edge zones of the upper fabric cuts folded at right angles.
FIG. 3 is a schematic view of the processing unit according to FIGS. 1 and 2 with the edge zones of the upper fabric cuts folded over.

FIGS. 1 through 4 show individual parts for forming the cuff, i.e., an insert 22 and two upper fabric cuts 23 and 24. According to the present .invention, the individual parts are placed one on top of another in a particular sequence. Thus, the insert side of upper fabric 23 and the top of upper fabric 24 are placed on the lower insert 22, which is provided with a coating facing upward for being bonded to the insert side of upper fabric cut 23. Narrow edge zones 26, 27 of the upper fabric cuts 23, 24, which are approximately of equal size and are otherwise flush with the insert 22, project at the long side 25 relative to the insert 22. These edge zones 26 and 27, which serve to form seams of the cuff, are first folded apart in opposite directions (FIG. 2) before being folding over and then folded completely over (FIG. 3). The edge zone 26 of the insert-side of upper fabric cut 23 will now come into contact with the uncoated lower side of the insert 22, while the edge zone 27 of the top of the upper fabric will come to lie on the top side of the upper fabric. This arrangement of the insert 22 and the upper fabric cuts 23 and 24, which is shown in FIG. 3, forms a processing unit 28 to be bonded together.

Figure 4:
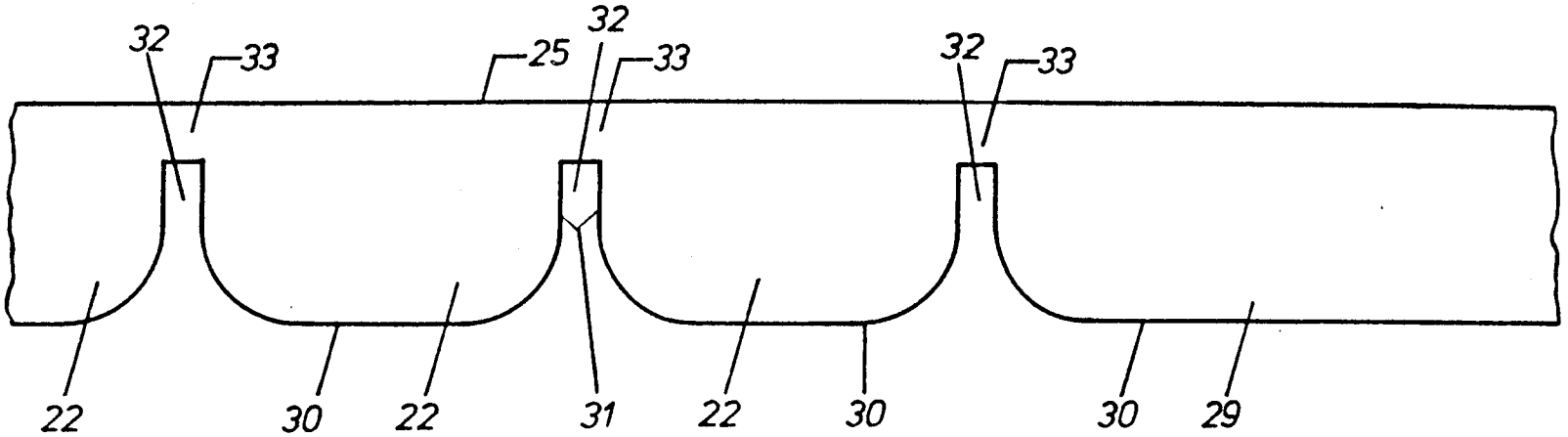
FIG. 4 is a top view of a continuous web of material for forming the inserts.

FIG. 4 shows the formation of inserts 22 from a continuous, coated web of material 29. Most of the inserts 22 are already cut or stamped out of the web of material 29, i.e., the long sides 30 of the inserts 22, which are provided with rounded parts, and the opposite front sides 31 of the inserts 22, which front sides adjoin the rounded parts, are brought to the final dimensions of the inserts 22. Thus, incisions 32 are formed between the successive inserts 22, but they do not extend to the straight long sides 25 of adjacent inserts 22. Consequently, a narrow residual connection 33, which maintains the strip-shaped character of the material web 29, is left between two inserts 22. Thus, the processing units 28 are bonded in the form of a series of units attached to one another in the form of a strip.

Figure 5:
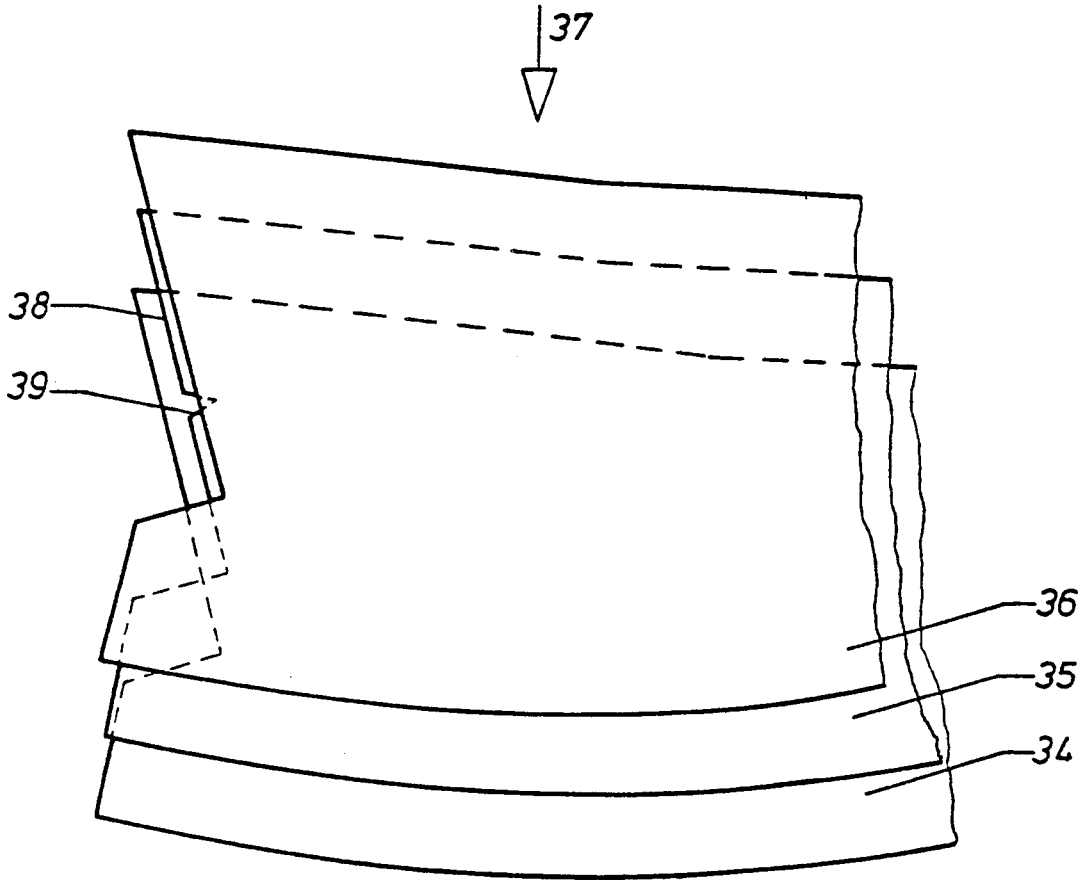
FIG. 5 is a perspective exploded view of a processing unit for a collar according to the invention.

FIG. 5 shows a processing unit 37 for a collar. This collar consists of a lower insert 34 in this case as well, with one side, the top side, being coated for bonding. Two upper fabric cuts 35 and 36, lying one on top of another, are placed on the insert 34. To form the collar, the insert 34 and the two upper fabric cuts 35 and 36 have equal surface area, i.e., they lie perfectly flush one on top of another.

The processing unit 37 has an insert side, upper fabric 35, of special design. This upper fabric 35 is provided with a stamped-out area, i.e., a notch 39, on each of its opposite front sides. Therefore, in the area of the notches 39, the insert 34 is bonded not only to the insert side upper fabric cut 35, but also to the top upper fabric cut 36. This is advantageous for the further processing of the collar, because its individual parts no longer need to be hemmed before sewing.

As an alternative to this, it is also possible to place the two upper fabric cuts 35 and 36 over a plurality of inserts to form collars.

Figure 6:
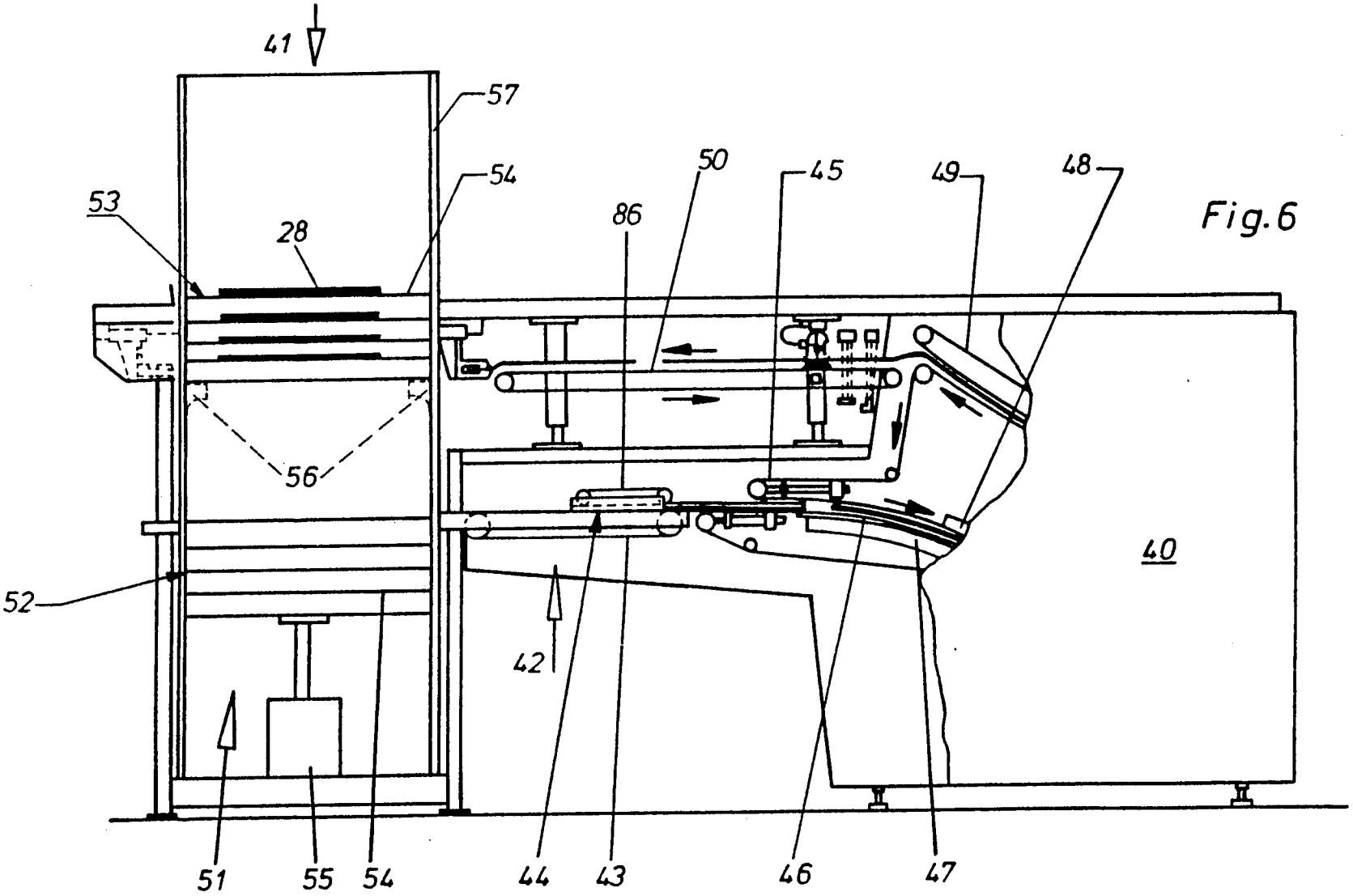
FIG. 6 is a side view of a device for bonding cuffs.

FIGS. 6 shows a device for bonding the cuffs. This device comprises a bonding press 40, which may have the design described in West German Offenlegungsschrift No. DE-OS 3,519,841, and a magazine arranged according to the present invention after the bonding press 40.

A bond is produced between the insert 34 and the superjacent insert side upper fabric cut 23 in the bonding press by applying heat and pressure. In front of the bonding press 40, i.e., on a feed station 42 of the press, the upper fabric cut 23 and then the upper fabric cut 24 are placed manually according to FIG. 4 on the inserts 22 formed by stamping or cutting from the continuous, coated material web 29 to form the processing unit 28. The edge zones 26 and 27 of the upper fabric cuts 23 and 24 are subsequently folded over along the delivery section of a belt type conveyor 43 associated with the feed station by a folding unit 44.

The processing unit 28 prepared so far for forming the cuff is subsequently delivered by a feed belt 45 to the bonding press 40. The processing unit 28 will then pass through said press in the usual manner; it is moved by a conveyer 46 past opposite heating plates 47 and 48. The bonded processing unit 28 is discharged by a return conveyor 49. According to the present invention, the processing unit 28 removed from the bonding press 40 by the return conveyor 49 is fed by an adjoining discharge conveyer 50—directly or via a transfer member following the discharge conveyor 50—to a magazine, i.e., a pallet type magazine 41, after severing the residual connection 33. This cutting can be performed with a simple cutting device or also by tearing off by the transfer member.

The device can also be designed analogously for processing units 37 for collars. However, this device has no folding unit, because no edge zones of the upper fabric cuts 35 and 36 need to be folded over for forming processing units 37 for collars. One or several inserts 34 are also usually introduced manually, i.e., not with a continuously moving, coated material web 29, when processing units 37 for collars are formed. It is also conceivable to feed in the inserts 22 manually when forming the processing units 28 for cuffs.

The pallet type magazine 41 shown in FIG. 6 has a pallet transport device 51, which forms pallet stacks within the device, i.e., one lower, empty pallet stack 52 and one upper, full pallet stack 53. The pallet stacks 52 and 53 are arranged one on top of another at spaced locations within the pallet transport device 51, so that the empty pallet stack 52 is located approximately at the level of the feed station 42, while a lower pallet 54 of the otherwise full pallet stack 53, which is still loaded with the processing unit 28, is located approximately in the plane of the discharge conveyor 50.

If the pallet transport device 51 is designed properly, this arrangement of the pallet stacks 52 and 53 makes it possible to raise the full pallet stack 53 in steps each time after a processing unit 28 is loaded into the lower pallet 54 by a new empty pallet 54 being pushed in from the downward direction. For this purpose, a corresponding lifting cylinder 55 is arranged under the empty pallet stack 52. In contrast, corresponding support pins 56, which can be displaced in the lateral direction and engage in a pallet shaft 57 to support the full pallet stack 53 but can be removed from the pallet shaft 57 sideways to push in a new pallet, are located under the full pallet stack 53.

This design of the pallet transport device 51 for the pallet magazine 41 makes it possible to remove a filled pallet 54 from the full pallet stack 53 and to place empty pallets 54 on the empty pallet stack 52 while the device is moving. Continuous operation of the device is thus guaranteed.

As an alternative to this, it is conceivable that a free space can be created between the pallet to be filled and the superjacent, filled pallet 54 with the above-described pallet transport device 51 and a pallet magazine 41 with the two pallet stacks 52 and 53 by bringing the upper pallet 54 of the lower empty pallet stack 52 to a level next to the discharge conveyer 50 for the bonded processing units 28 and holding the upper full pallet stack 53 above it at a spaced location from it. The space thus created between the pallet 54 to be filled and the superjacent, full pallet 53 is used to introduce processing units 28 into the corresponding pallet 54 unhindered.

Figure 7:
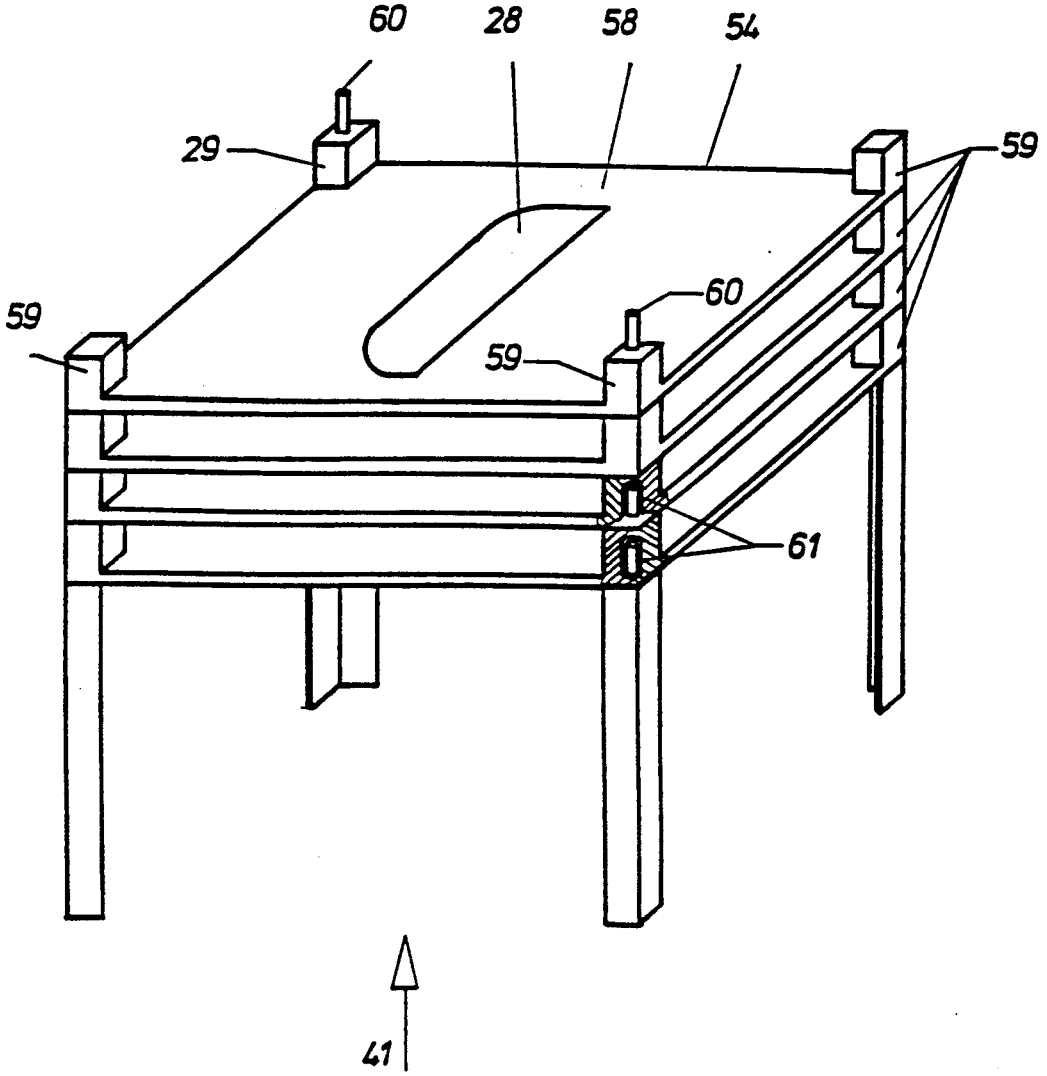
FIG. 7 is a perspective view of a first embodiment of a magazine for the device according to FIG. 6.

FIG. 7 shows the design of pallets 54 of the pallet magazine 41. According to this design, each pallet 54 has a rectangular or square pallet base plate 58 on which four spacers are arranged in the corners of the pallet base plate 58. Two spacers 59, preferably arranged in diametrically opposed locations, are provided here with upwardly projecting centering pins 60. These pins engage from the downward direction in holes of corresponding shape provided in the pallet 54 to be deposited to center the pallet. The dimensions of the pallet base plate 58 are such that it serves to receive one processing unit 28 of one cuff.

Figure 8:
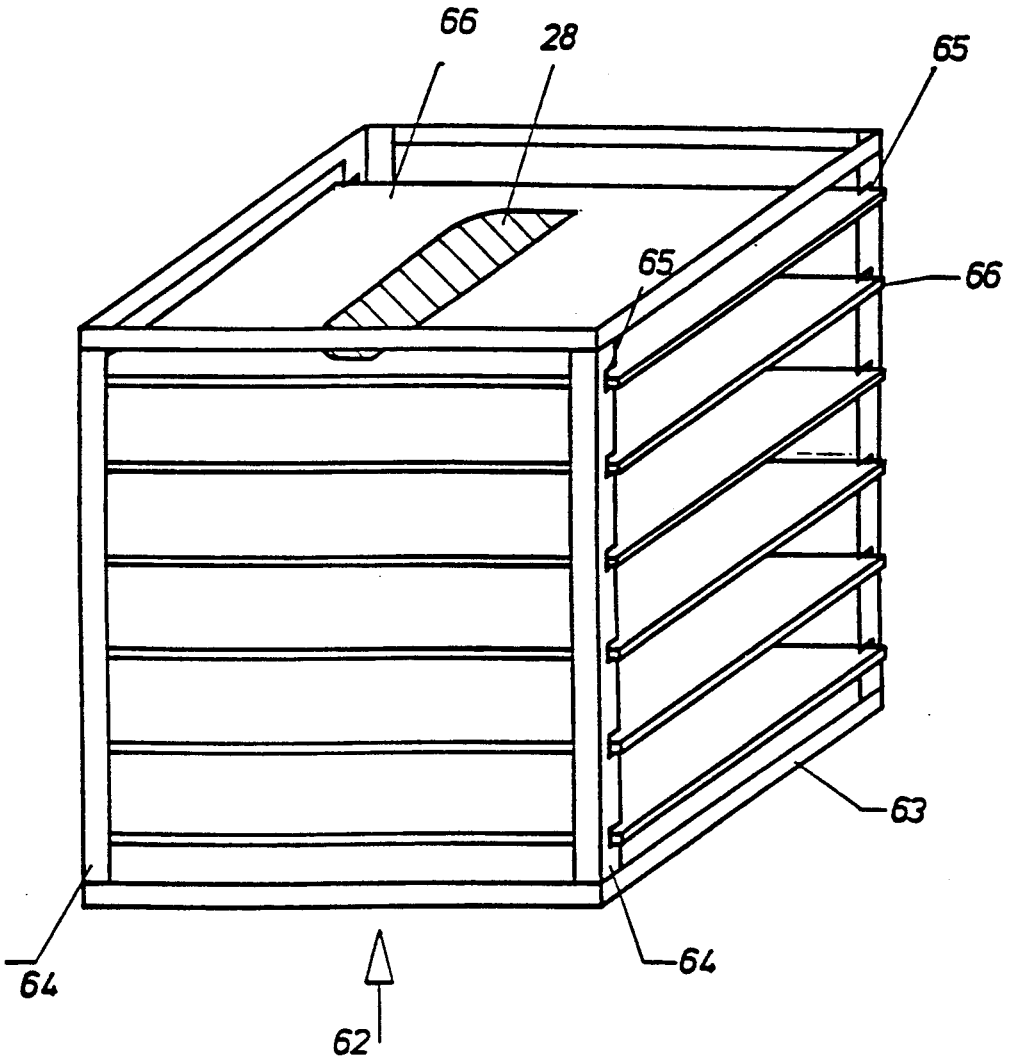
FIG. 8 is a perspective view showing a second embodiment of the magazine.

FIG. 8 shows an alternative embodiment of a magazine, i.e., a shelf type magazine 62. This has a three-dimensional support frame 63 consisting of four upright corner sections 64 connected to each other. Slots 65 are provided in the corner sections, in a plurality of superjacent horizontal planes. The slots serve to receive support plates 66 of appropriate design, whose base is adjusted to the dimensions of the three-dimensional support frame 63. Each of the support plates 66 serves to receive at least one—in the case shown, two—processing units 28. These processing units can be pulled out of the three-dimensional support frame 63 in the lateral direction one by one, but, according to a particular characteristic of the shelf type magazine 62, can also be pulled together with the support plate 66 associated with them to facilitate the loading and emptying of the shelf type magazine 62.

Figure 9:
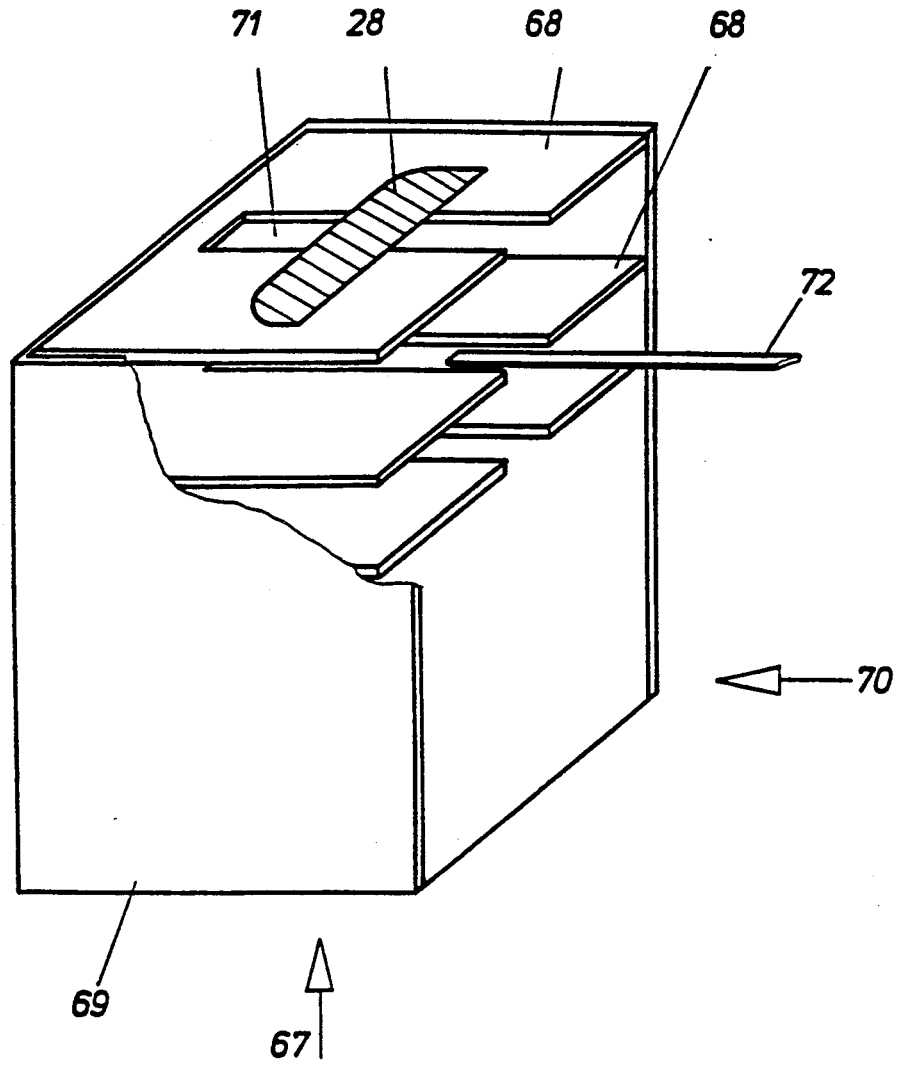
FIG. 9 is a perspective view showing a third embodiment of the magazine.

Finally, FIG. 9 shows another embodiment of a magazine, which is also designed as a shelf type magazine 67. This has a plurality of horizontal support plates 68 arranged one on top of another at spaced locations, which are rigidly connected to a housing 69 that is open on one side. Central and approximately full-length slots 71 are provided in each of the support plates 68 beginning from the open side 70 of the housing 69. These slots 71 are designed for the mechanical removal and, if also desired, also for the mechanical introduction of the processing unit 28, placed on the support plate 68 transversely over the corresponding slot 71 from and into the shelf type magazine 67 by means of a material handling member designed as a simple tongue 72 in FIG. 9.

The above-described magazines, especially the shelf type magazines 62 and 67, can be designed as traveling magazines. In the simplest case, the three-dimensional support tracks 63 or the housing 69 have corresponding rollers on the lower side. The magazines, and specifically preferably individual pallets 54 or pallet stacks 52, 53 of the pallet magazine 41, can also be transported by appropriate transport members.

Finally, the magazines may also be used to receive a plurality of groups of stacked-up pallets 54 or support plates 66 or 68, which groups are arranged adjacent to each other.

Figure 10:
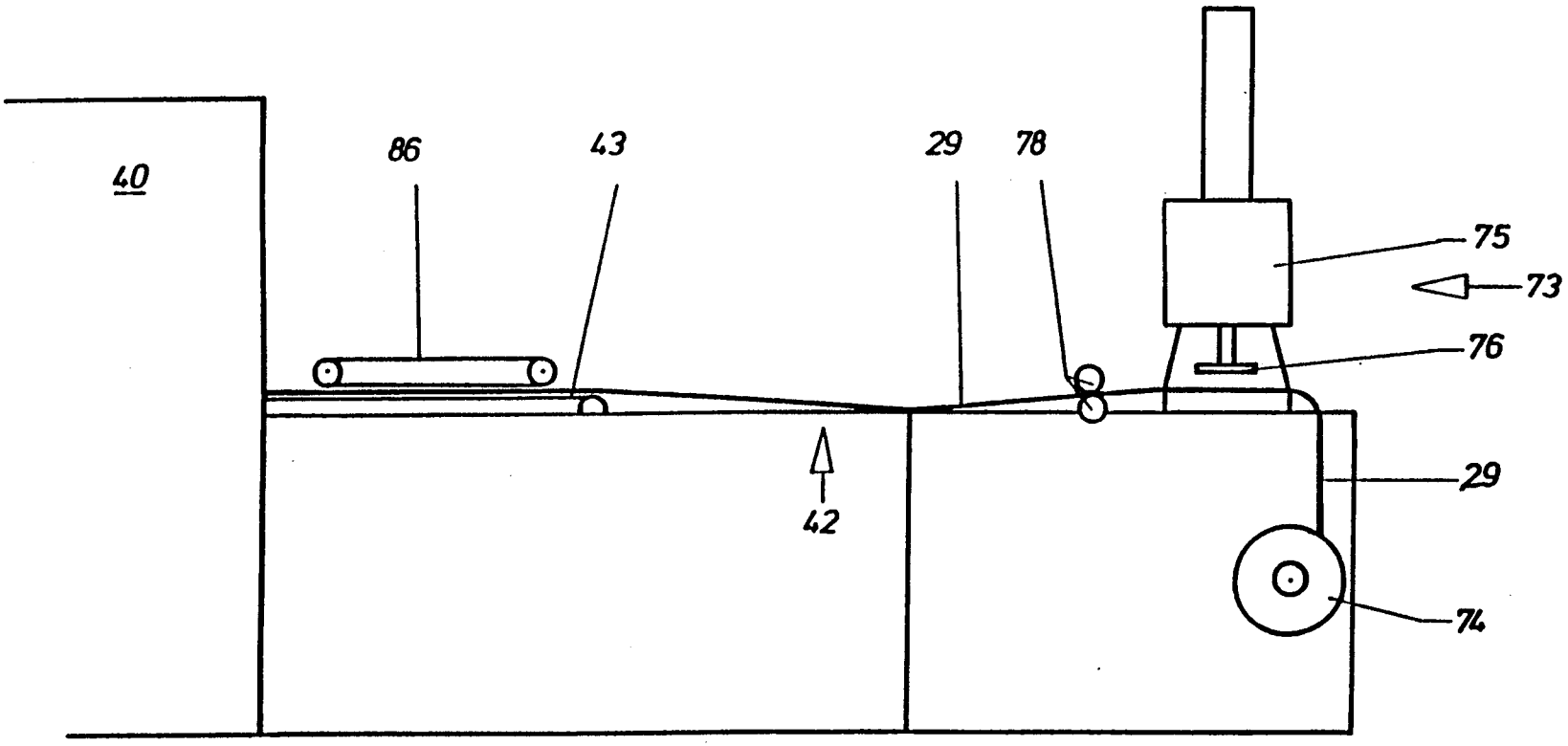
FIG. 10 is a schematic side view of a stamping device associated with the device for forming inserts partially stamped out of the continuous web of material according to FIG. 4.
Figure 11:
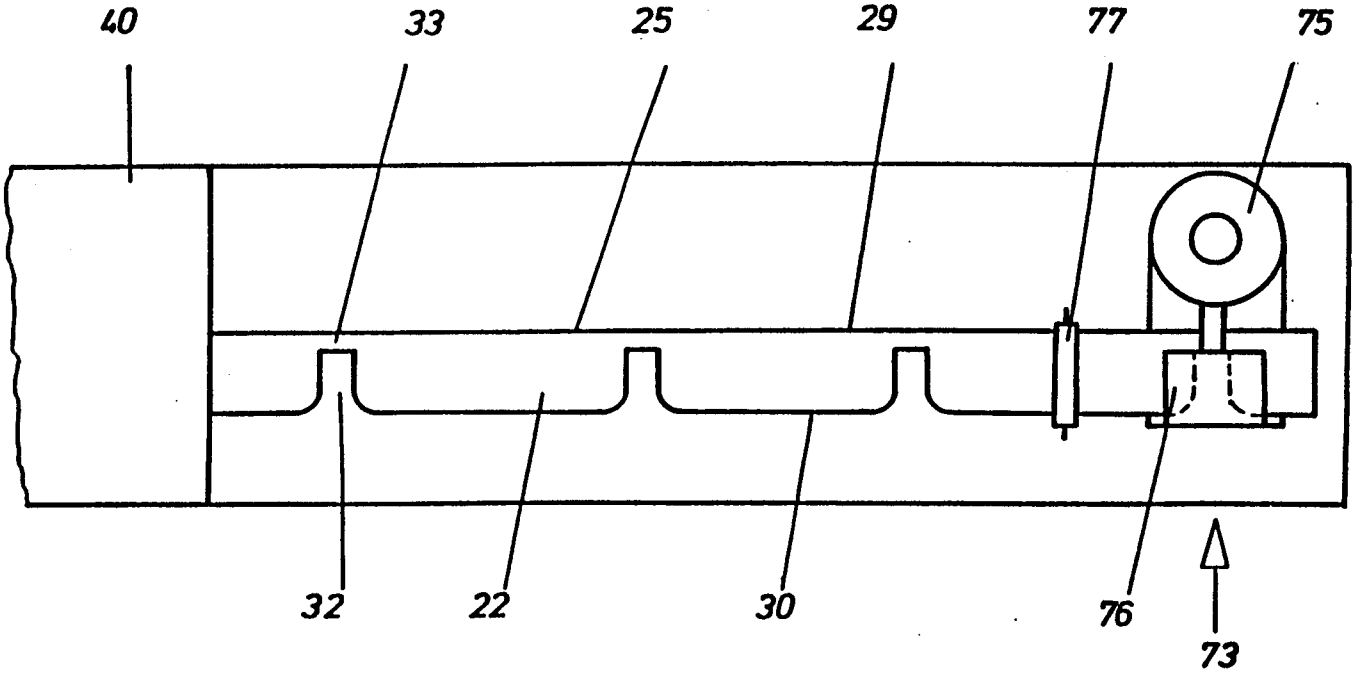
FIG. 11 is a top view of the stamping device according to FIG. 10.

FIGS. 10 and 11 show a section of the device preceding the feed station 42, namely, a stamping device 73 for stamping the contours of the inserts 22 out of the material web 29. The latter is pulled continuously from a roll of material 74 and is fed to a stamping unit 75 of known design, which has a die with an approximately square base that can be moved cyclically up and down FIG. 11. The contours for the incision 32 and the opposite inserts 22 joining the incision toward the front side 31 are produced in the die 76.

The stamping device 73 operates with a lead relative to the bonding press 40 and the feed station 42. This lead is brought about by a pair of transport rollers 77 arranged behind the stamping unit viewed in the direction of feed, which pulls the material 29 through the stamping device 73, which preferably operates cyclically and pushes the material already processed in front of it. This lead creates a buffer 78 between the stamping device 73 and the further processing of the inserts 22 stamped out of the material web 29, which compensates for differences in movement between the cyclic stamping operation and the subsequent continuous processing in the bonding press 40, as a result of which continuous operation of the entire device is made possible.

Figure 13:
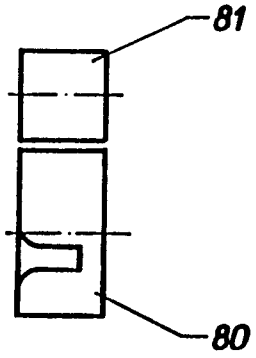
FIG. 13 is a front view of the cutting device according to FIG. 12.
Figure 12:
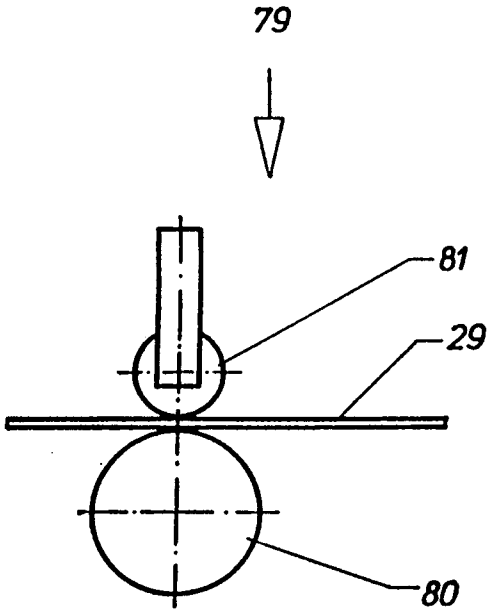
FIG. 12 is a side view of a cutting device for producing inserts partially cut out of the continuous web of material according to FIG. 4.

FIGS. 12 and 13 show a cutting device 79 for cutting the inserts 22 out of the material web 29. It can be arranged in the place of the stamping device 73 of the unit.

The cutting device 79 has a lower knife roller 80 and an upper counterroller 81. The material web 29 to be cut is passed through between the knife roller 80 provided with the contours of the incision 3 and the rounded parts adjacent to it for the inserts 22 and the counterroller 81, preferably while the rollers are driven at the same time.

FIGS. 14 through 17 show the folding device 44 of the device according to the present invention, which joins the feed station 42. The material web 29, provided with the incisions 32, passes through this folding device in the direction of arrow 82, lying on the belt type conveyor 43 and being further transported by the conveyor. Thus, the inserts 22, which are still connected to one another at the residual connections 33, enter the folding device 44 with the upper fabric cuts 23 and 24 placed over them and with the edge zones 26 and 27 of the upper fabric cuts 23 and 24 projecting beyond the long side 25 of the inserts 22. A tongue 83 now enters between the two, still flat upper fabric cuts 23 and 24 FIG. 15. The edge zones 26 and 27 are lifted off from one another by the tongue 83 to such an extent that two opposite folding plates 84, 85 will increasingly fold the two edge zones 26 over along the transport direction arrow 82 FIGS. 16 and 17. The folding plates 84 and 85 are made in one piece with the tongue 83 in this case, i.e., they are an integral part of the tongue 83. It is also conceivable to design the tongue 83, on the one hand, and the folding plates 84 and 85, on the other hand, as separate individual parts.

Figure 14:
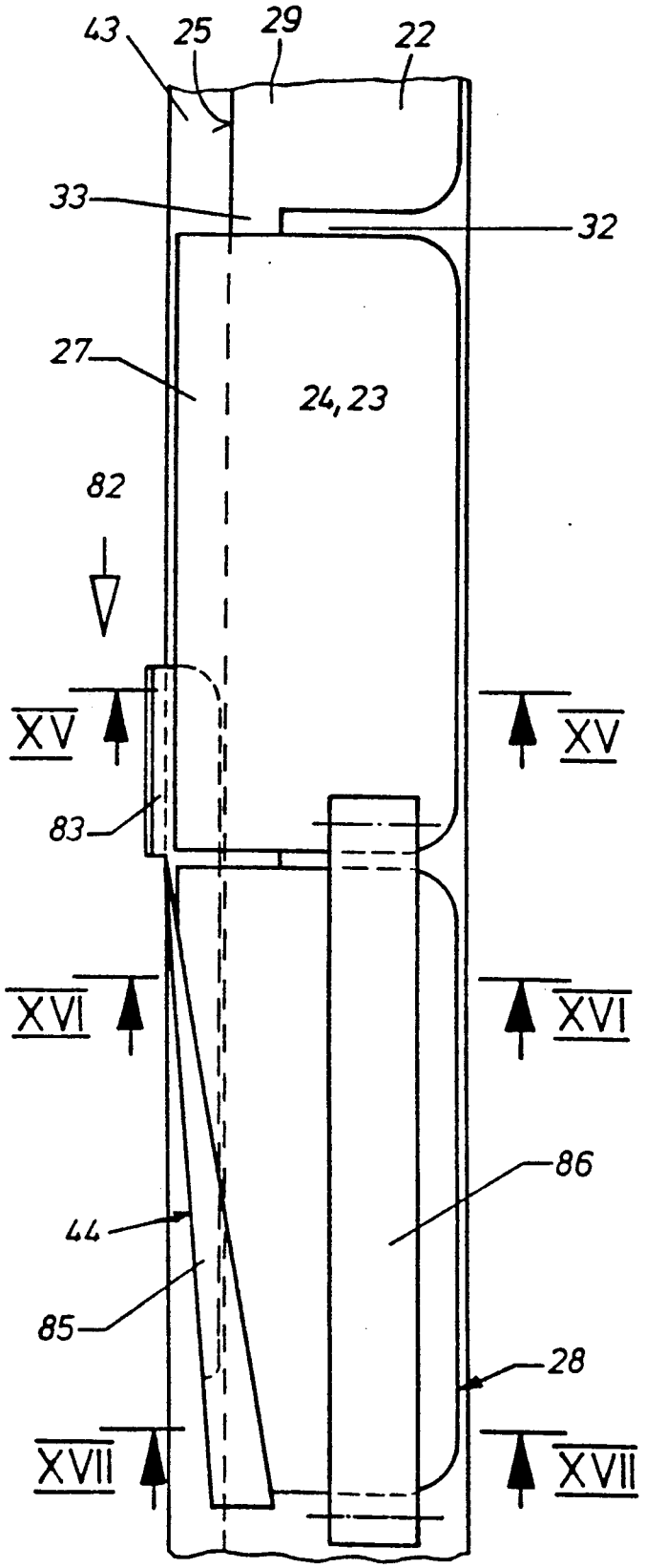
FIG. 14 is a schematic top view of a folding unit provided with guides for the edge zones of the upper fabric cuts.
Figure 15:
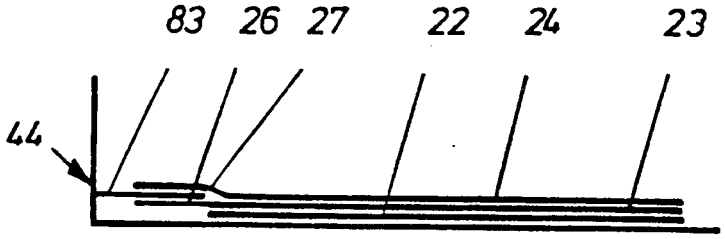
FIG. 15 is an enlarged vertical sectional view taken along XV—XV through the folding unit according to FIG. 14.
Figure 16:
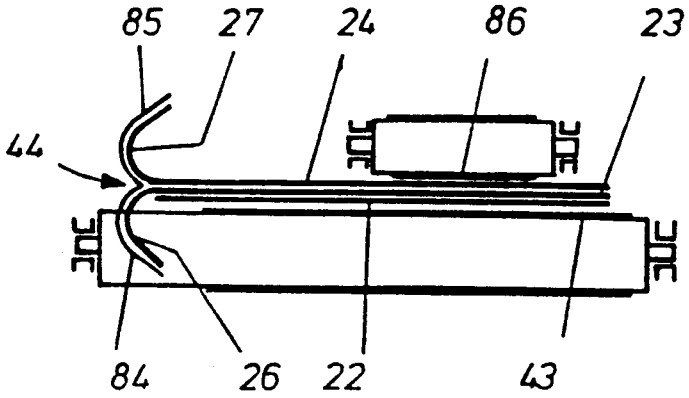
FIG. 16 is an enlarged vertical sectional view taken along XVI—XVI through the folding unit according to FIG. 14.
Figure 17:
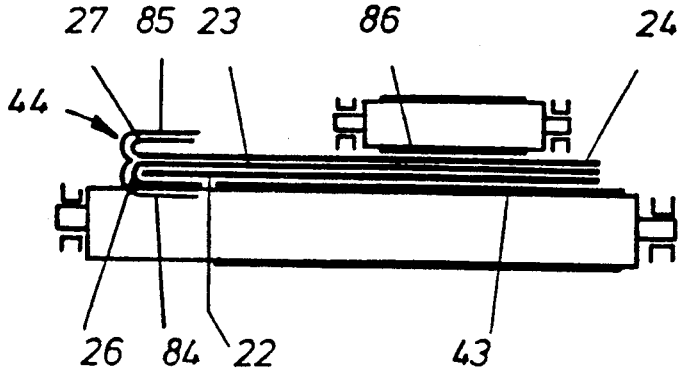
FIG. 17 shows an enlarged vertical sectional of view along XVII—XVII through the folding unit according to FIG. 14.

As can also be determined from FIGS. 14 as well as 16 and 17, that a driven, rotating holding belt 86 is arranged next to the tongue 83 and the folding plates 84 and 85 for fixing the upper fabric cuts 23 and 24, which have been placed loosely over the inserts 22, and are still connected to each other, in the area of the folding device 44, and especially in the area of the folding plates 84 and 85. Thus, in this area the inserts 22 and the upper fabric cuts 23 and 24 are passed between the holding belt 86 and the belt type conveyor 43 in the area of the feed station 42.

While specific embodiments of the invention have been shown and described in detail to illustrate the application of the principles of the invention, it will be understood that the invention may be embodied otherwise without departing from such principles.

I claim:

1. Device for producing multilayered individual parts of garments, especially collars and cuffs, comprising: bonding station means for bonding together upper fabric cuts and inserts, conveyor belt means for passing processing units formed by upper fabric cuts and inserts through said bonding station means, as well as a magazine arranged near said bonding station means at an output side thereof for receiving the processing units, said magazine being arranged after the bonding station means and being designed to receive, store, and discharge individual processing units and being formed as a pallet type magazine with a plurality of pallets having means to stack one pallet on another so that said pallets can be stacked up and can be handled one by one, wherein each pallet is designed to receive one processing unit.

2. Device in accordance with claim 1 wherein the magazine is designed as a pallet type magazine with a plurality of pallets having means to stack one pallet on another so that said pallets can be stacked up and can be handled one by one, wherein each pallet 54 is designed to receive one processing unit.

3. Device in accordance with claim 1, wherein the magazine is designed as a movable unit that can be placed on a conveyor.

4. Device in accordance with claim 1 wherein pallet base plates of the magazine can be moved in height and/or laterally away from each other to facilitate the feeding in and the removal of the processing units.

5. Device in accordance with claim 1 wherein the bonding station means is preceded by a folding device for folding over edge zones of the upper fabric cuts during the production of cuffs.

6. Device in accordance with claim 5, wherein the folding device is formed by folding plates extending in a direction of delivery of the upper fabric cuts, said folding plates designed so that the edge zones of the upper fabric cuts are gradually folded during the transport of the upper fabric cuts.

7. Device in accordance with claim 1 wherein the bonding station means is preceded by a stamping device or a cutting device, so that inserts can be completely or partially stamped or cut out of material webs during the processing of material webs.

8. Device in accordance with claim 7, wherein continuous operation of the bonding station means and intermittent operation of the stamping device or cutting device is operated with a slight lead toward the bonding station means.

9. Process for producing multi layered individual parts of garments, comprising: assembling an upper fabric cut for an inner collar, an upper fabric cut for an outer collar and one of an insert and a plurality of inserts; arranging at least one coated insert, which is to be bonded to one of said upper fabric cut for an inner collar and upper fabric cut for an outer collar in a bonding press, to form a processing unit with a coated side of side coated insert facing said one of said upper fabric cut for the inner collar and said upper fabric cut for the outer; bonding the processing unit to bond the at least one coated insert to said one of said upper fabric cut; and subsequently placing the processing unit with bonded parts in a magazine.

10. Process for producing multi layered individual parts of garments, comprising: assembling an upper fabric cut for an inner cuff, an upper fabric cut for an outer cuff and an insert; arranging at least one coated insert on one of said upper fabric cut for an inner cuff and upper fabric cut for an outer cuff to form a processing unit with a coated side of said coated insert facing said one of said upper fabric cut for an outer cuff and said upper fabric cut for an inner cuff; bonding the processing unit in a bonding press to bond the coated insert to said one of said upper fabric cut; and placing the processing unit after pressing in the bonding press into a magazine.

11. Process in accordance with claim 9 or 10, wherein during said step of arranging the upper fabric cuts and inserts are placed on a belt type conveyor of the bonding press with an outer side of said upper fabric cut for an outer collar facing an outer side of said upper fabric cut for an inner collar.

12. Process in accordance with claim 9 or 10, wherein, when preparing cuffs and collars, the inner upper fabric cut is arranged on top and the outer upper fabric cut is arranged on the insert.

13. Process in accordance with claim 9 or 10, wherein the insert is fed into the bonding process as a continuous, coated material web, the upper fabric cuts are placed on the material web, and the insert is cut out of the material web after leaving the bonding press.

14. Process in accordance with claim 13, wherein before the upper fabric cuts are placed on the material web, the material web is subdivided into inserts by one of stamping and cutting so that the inserts are still connected to one another by at least one point, when viewed in a direction of delivery, by a part residual connection part of the material web.

15. Process in accordance with claim 10 wherein edge zones the upper fabric cuts, which project beyond the insert, are folded over upward and downward prior to bonding with the insert and are passed through the bonding press in this position.

16. Process in accordance with claim 15, wherein areas of the upper fabric cuts that are not be folded over lie between two belt type conveyors and are held displacement-free by said two belt type conveyors during the folding process.

17. Process in accordance with claim 11 wherein upper fabric cuts are positioned essentially flush with the insert, a middle of said upper fabric cuts is provided with one of cutouts and stamped-out openings especially at corners, so that during bonding, an outer top upper fabric cut will be bonded to the insert in the area of the openings.

* * * * *